US006829794B2

(12) United States Patent
Lenyo

(10) Patent No.: US 6,829,794 B2
(45) Date of Patent: Dec. 14, 2004

(54) INFANT AND CHILD BACK HEAD CURVE SUPPORT PAD

(76) Inventor: Ann B. Lenyo, 104 South La., Orchard Park, NY (US) 14127-3337

( * ) Notice: Subject to any disclaimer, the term of this patent is extended or adjusted under 35 U.S.C. 154(b) by 0 days.

(21) Appl. No.: 10/378,583

(22) Filed: Mar. 3, 2003

(65) Prior Publication Data

US 2004/0172762 A1 Sep. 9, 2004

(51) Int. Cl.[7] ..... A47G 9/00

(52) U.S. Cl. ..... 5/636; 5/640; 5/655; 5/729; 128/845

(58) Field of Search ..... 5/636, 637, 638, 5/640, 655, 729, 630, 632; 128/845

(56) References Cited

U.S. PATENT DOCUMENTS

| | | | | | |
|---|---|---|---|---|---|
| 1,517,617 | A | * | 12/1924 | Cleveland | 5/729 |
| 3,276,046 | A | * | 10/1966 | Capelli | 5/636 |
| 3,848,281 | A | | 11/1974 | Matthews | |
| 4,383,713 | A | | 5/1983 | Roston | |
| 4,768,246 | A | * | 9/1988 | Summer | 5/636 |
| 5,048,136 | A | | 9/1991 | Popitz | |
| 5,546,620 | A | | 8/1996 | Matthews | |
| 5,586,351 | A | | 12/1996 | Ive | |
| 6,006,380 | A | * | 12/1999 | Sramek | 5/636 |
| 6,052,849 | A | | 4/2000 | Dixon et al. | |
| 6,052,850 | A | | 4/2000 | Salido et al. | |
| 6,260,553 | B1 | | 7/2001 | Mann | |
| 6,321,403 | B1 | | 11/2001 | Matthews | |

* cited by examiner

*Primary Examiner*—Alexander Grosz

(57) ABSTRACT

The infant head pad is designed to support and cradle the outer circumference of the head with little or no pressure on the back of the head to flatten it causing a deformity. The pad has different size cutouts with a ledge to closely fit and support the head. The cutouts with a ledge begin small enough for a newborn and increase slightly in diameter from cutout to cutout to provide a custom fit, maintaining the back head curve as the head grows. They are strategically around the pad to allow room for the infant's body to lay comfortably on the pad. The cutouts are small and unobtrusive, not restrictive in any way to the child. Plugs fill cutouts not in use, providing a level surface.

8 Claims, 2 Drawing Sheets

INFANT AND CHILD BACK HEAD CURVE SUPPORT PAD

CROSS REFERENCE TO RELATED APPLICATION

Figure 1:
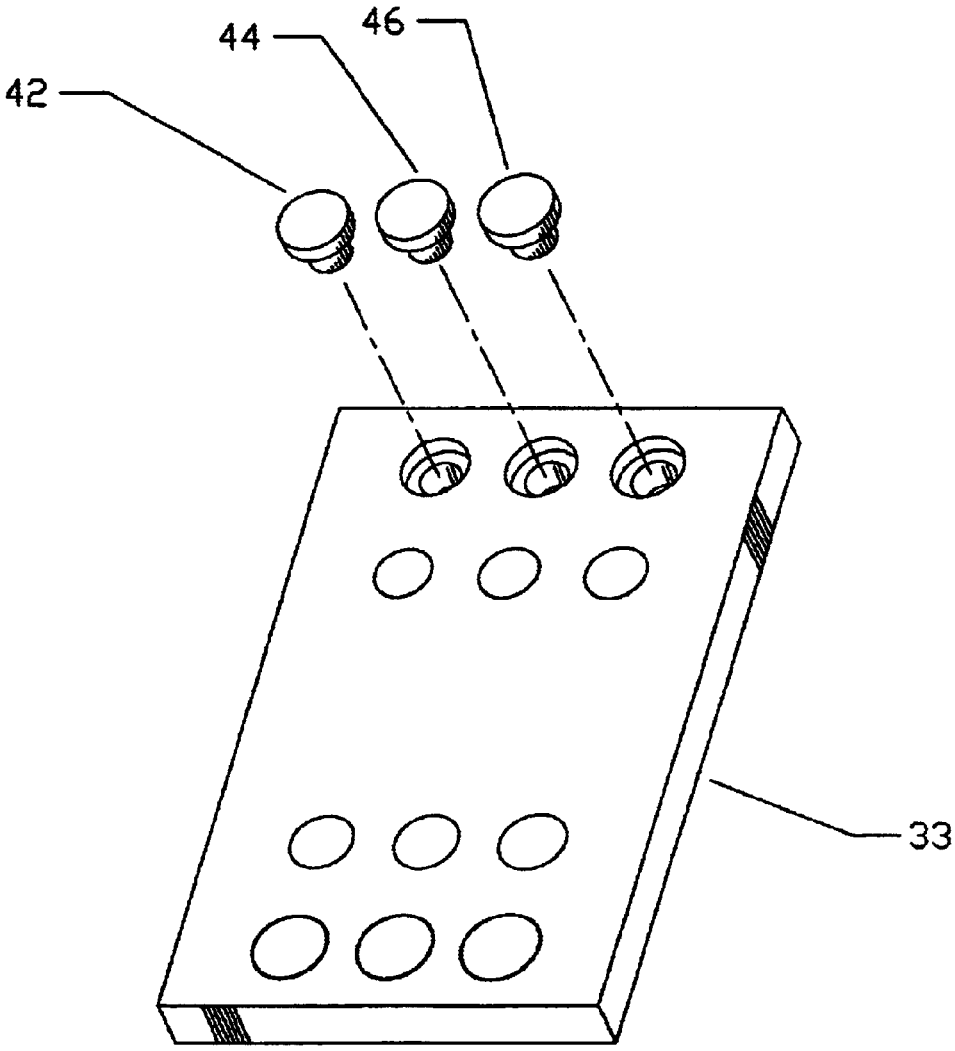

This invention refers to the Document Disclosure number 519242, dated Oct. 1, 2002 Lenyo, Ann.

FEDERALLY SPONSORED RESEARCH

Not Applicable

SEQUENCE LISTING OR PROGRAM

Not Applicable

BACKGROUND OF THE INVENTION

1. Field of Invention

This invention relates to infant head support pad while sleeping to prevent flat head syndrome, specifically it relates to a pad with holes and ledges in them to support and put pressure only on the outer circumference of the back head.

2. Background of Invention

We are born with a pronounced curve to the back of our head. This curve begins at the crown down to the bottom of the head. Currently Pediatricians strongly advise parents to sleep their infants exclusively on their backs to reduce the incidents of Sudden Infant Death Syndrome or SIDS. The infants sleep on their backs for about the first six to eight months of life before rolling over and sleeping on the side or belly. Crib mattresses are too firm and flat, causing a pressure point on the center back of the head. This constant pressure of the baby crib mattress and/or bassinet pad on the back of the head flattens the curve of the head, leaving it to look odd and deformed; permanently altering the natural growth pattern of the brain and the natural curve of the head. The newborn must sleep with the head turned to the extreme left or right because there is no support for other angles. It takes about two years for the skull and our other bones to harden. Until this time, children's bones are soft like cartilage, and very pliable. A disabled infant may lay on their back for a longer period of time causing a more flattening effect. After time most infants learn to roll over and sleep on their side and belly. However, too many children prefer to lay on their backs interfering with the natural growth and development of the skull. In fact many children's and adults' heads are left with only a slight curve at best; too many have flat deformed back heads. A disabled child may lay exclusively on its back for much longer periods of time, causing severe deformity to the skull. There are several infant support pads to deal with flat head syndrome or plagiocephaly. They include different types of foam construction, foam pad contouring, shapes, angles and contour pillows. For example U.S. Pat. No. 6,473,923 to Straub, 2002 Nov. 5, and U.S. Pat. No. 6,421,855 to Mann, 2002 Jul. 23, and U.S. Pat. No. 6,260,553 to Mann, 2001 Jul. 17, are incline smooth flat pads for the infant to lay on, their is no depression or contouring for the head, the inventors simply use an incline to somehow release the pressure point on the back of the head. It does not seem probable that much pressure is able to be reduced, just transferring a little to the baby's back. U.S. Pat. No. 6,321,403 to Matthews, 2001 Nov. 27, uses a contour pillow attached to a pad with a hole in it. This may offer a little pressure relief but does not provide a custom fit. It does put some pressure on the sides of the head, but also puts some on the back head. U.S. Pat. No. 6,266,832 to Ezell, 2001 Jul. 31, invented a doughnut shaped pillow to relieve pressure, with the outer support angled in which would help, but infants do not have enough neck length to use a pillow, it can strain the neck, it is not custom fitted to the head and is for use in a car seat. It is somewhat close to my invention, but does not offer different sizes for a custom fit, and may not offer enough support for the infant to tilt its head at differing angles. The other inventions are contour pillows with a depression in them to conform to the head, but do not offer enough support for the sides of the head to relieve pressure on the back head, plus there is still pressure on the center back head. The patents are: U.S. Pat. No. 6,263,526 to Tu, 2001 Jul. 24, and U.S. Pat No. 6,052,850 to Salido, 2000 Apr. 25, and U.S. Pat No. 6,052,849 to Dixon et. Al, 2000 Apr. 25, and U.S. Pat No. 4,383,713 to Roston, 1983 May 17. These inventions without a hole in the pad or pillow do not relieve the pressure, and the pillow with a hole offers only a small fraction of support because it is not versatile enough to accommodate the many different sizes of infant heads and allows for pressure to be put on the neck. Parents will want a product that will offer a custom fit at all stages of growth, deep enough to only support the outer circumference of the head, and one that puts no pressure at the back when the head is turned face upward.

BACKGROUND OF THE INVENTION—OBJECTS AND ADVANTAGES

Accordingly, several objects and advantages of the present invention are:

a) to provide cutouts in increasing diameter from cutout to cutout resulting with a custom fit at all stages of growth for all infants from birth until they no longer sleep predominantly on their back b) to provide cutouts with ledges, or holes with counterbores, placed strategically around the pad to allow enough room for the child's body to lay comfortably on the pad c) to provide a cutout design with ledges measured to snugly fit and spread a band of pressure evenly around the outer circumference of the back portion of the head d) to provide a ledge or inner support rim, inside each cutout, extending to the bottom of the pad for extra support e) to provide a design with zero pressure on the large curve on the middle back of the head to provide a design to support and cradle the head in many different angles and not just straight ahead or the extreme left or right position f) to provide a design that does not restrain the head; the head is not stuck in the cutout g) to lay on top of mattress or in place of bassinet pad for easy placement and removal to provide convenience and portability h) to provide for a more flexible support with give for superior comfort i) to allow the head to grow more naturally by maintaining the curve to the brain and back of the head j) foam plugs fill in all cutouts except the one in use, providing a level surface.

k) there is a custom cover for the pad, and the plugs which can be removed and laundered.

l) the fabric cover is customized to fit the pad and in the cutouts; the fabric and plugs are securely fastened to the bottom of the pad cover for safety.

SUMMARY

The Infant and child back head support pad comprises a pad most probably composed of foam large enough for an infant's body to lay on, one or several different size holes with counterbores or cutouts with ledges or inner support rims down in the cutout, measured to snugly fit and put pressure only on the outer circumference of the back of the head, plugs for all cutouts providing a level surface, a custom cover over the pad and plugs for cutouts not in use, with fasteners to secure the cover and plugs to the pad. This pad can be in various sizes with various numbers of holes with ledges. The primary version is for a crib mattress foam pad about half the mattress length and almost as wide. There are about twelve cutouts with ledges in total, placed six at one end in two rows of three and two rows of three each at the opposite end. The cutouts of two rows of three each are centered and far enough apart from each other and the edge for support and comfortable placement of infant. The cutouts with ledges are strategically placed for comfort and support. A secondary version of the pad is for a bassinet and is the size of the bassinet pad and in place of it. The pad has about four cutouts with ledges in total, two cutouts with ledges side by side at each end.

DRAWINGS—FIGURES

Figure 2:
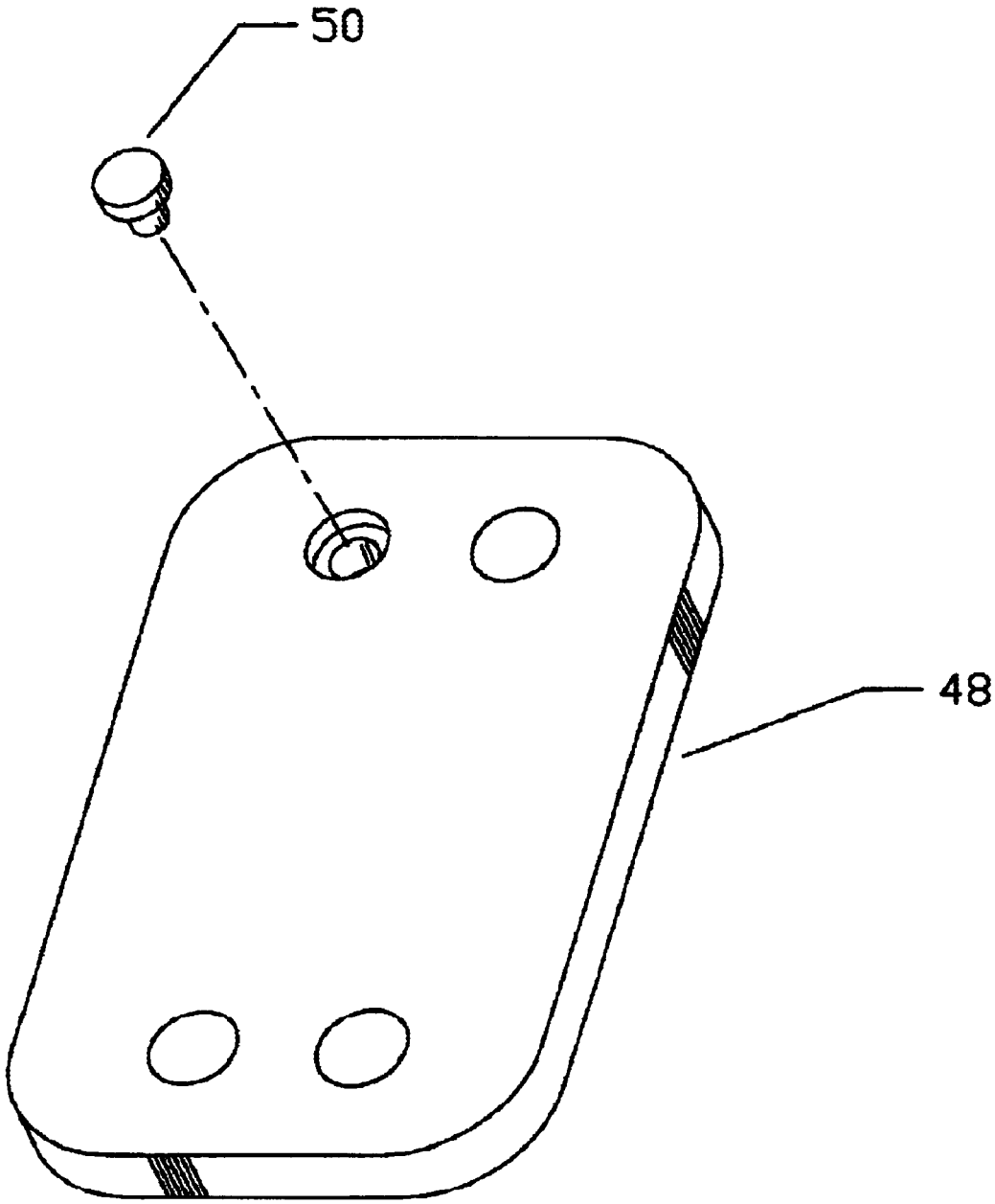

FIG. 1 shows a foam pad for a crib mattress, having a dozen cutouts with inner ledges; and FIG. 2 shows a bassinet pad, having four cutouts with inner ledges.

WINGS—REFERENCE NUMERALS

10 smallest hole
12 second smallest hole
14 third smallest hole
16 fourth smallest hole
18 fifth smallest hole
20 sixth smallest hole
22 seventh smallest hole
24 eighth smallest hole
26 ninth smallest hole
28 tenth smallest hole
30 eleventh smallest hole
32 largest hole
33 crib pad with plugs in cutouts and out
34 hollow cylinder
36 solid cylinder used for plug base

DETAILED DESCRIPTION OF INVENTION—PREFERRED EMBODIMENT

A preferred embodiment of the pad of the present invention is made by a foam mold injection machine or a laser cutter, and glue gun. Constructed of a foam pad of regular density foam, and longer than an infant to fully support the body. The crib size is cut with a foam cutter or a laser cutter. A foam mold injection machine molds the circular cutout with a ledge, or a laser cutter can be used. The measurements are about 25 inches by 40 inches by 3 inches. The width is almost as wide as a crib mattress and length is to be long enough for the average toddler who is old enough to roll over on their side or belly, plus extra room for comfort and safety. It can be longer for disabled children as well. The pad height should be three inches high. The cutouts are circles, but not limited to. The circular cutouts are centered in the middle of the foam pad in two rows of three circles. All circles; are centered in the middle and at least 2 inches from the edges and 1.5 inches apart for support. The remaining circular cutouts should also be spaced 2 inches from outside edges or more, and 1.5 inches from each other for support.

In FIG. 1 a pad 33, for the support of the back of the head of an infant is shown, with a plurality (12) of spaced apart cutouts of increasing diameters, said cutouts having inner ledges disposed within said pad, and spaced below the top surface of the pad. The figure shows a plurality of plugs 42, 44, 46 that are adapted to mate with the cutouts having inner ledges, to provide a planar supporting surface, when the plugs are positioned within the cutouts.

FIG. 2, shows a bassinet pad 48, with four spaced apart cutouts of increasing diameter, with inner ledges disposed within the pad, and spaced below the top surface of the pad.

Plug 50, adapted to mate with a cutout, is shown above the cutout adapted to accommodate it, with the three other cutouts filled by their respective plugs.

The plugs can be covered with a fabric cover, and the pad can be covered with a fabric cover that has a zipper closure with a fabric cover that has a zipper closure and snap fasteners to attach the top of the cover to the bottom of the cover.

The manner of using the Infant and child back head support pad is by placing the infant in the first cutout with ledge, then proceeding to the next higher numbered of said cutout if proper fit is not achieved. Proper fit is defined as little or no space between the edge of cutout and head, the chin is pointed out at about a forty-five degree angle from the baby's neck and the head is not extended back, and there is about a one inch clearance between the child's ear edge and the foam pad. To determine proper fit the caregiver places the newborn's head in the smallest cutout; if there is little or no space between the edge of the cutout and the head, and the chin is pointed up along with the neck being extended, the cutout is too large and caregiver should wait until proper fit is achieved. If the said chin is down, and or touching baby's chest, the said cutout is too small and the baby should move to the next larger cutout. Mothers critiquing this process could tell instantly if the baby was in the correct cutout with ledge by viewing the head tilt; if it was forward or backward too much. The cutouts are small and unobtrusive to the child so it can easily move its head from side to side if it chooses, it is not stuck in one position in the cutout which makes it very comfortable, and the caregiver can easily adjust the baby's head as it sleeps. There are many cutouts to accommodate the wide range of baby head sizes. A baby will only use the cutouts that properly fit its head, all the cutouts may not be needed. When the infant learns to roll over and sleep predominantly on their side or stomach, the foam pad is no longer needed. The said pad, plugs and cover lay on top of the crib mattress or bassinet and can be easily removed. The cutouts can be numbered beginning with number one for the smallest cutout and progress upwards to approximately twelve to fourteen for the crib pad, or about four respectively, for the bassinet pad. The numbers are clearly visible on the pad cover and foam pad itself to aid in conveying to others what size is currently in use. Foam plugs fill in the cutouts not in use, providing a level surface. These plugs are secured to the foam pad with a fastener for safety.

The Infant and child back head support foam pad is firm but flexible and deep enough for support. The inner support ledge provides the main support, while the cutouts blend with the ledge providing a wide band of support and comfort and allow the infant's head to rest on at many different angles, the head is not restrained in any way. The pad can be small enough for a cradle or bassinet with fewer cutouts, or larger to fit on top of a standard baby crib mattress. It has a custom cover, and a zipper on the edges for removal and laundering. The foam plugs are also covered and can be laundered. The foam pad lies on top of the mattress and baby sheets and is not attached to them for easy removal and transport.

Many parents will want to begin sleeping their newborn in a bassinet. Therefore another useful embodiment would be a foam pad for a newborn. Many bassinet pads are measured to be about 30×14 inches. A foam pad is cut to equal the bassinet foam pad. Four circular cutouts are cut. Two on one end and two on the opposite end. The circular cutouts are to be centered as well as possible. The circular cutouts should be centered at each end of the pad, cut about 2 inches in from the outside edges, and about 1.5 inches apart for proper support. The circular cutouts are measured to be equal to the first four circular cutouts as the crib mattress size, which is about 3.3 inches, 3.4, 3.5 and 3.6 inches in diameter. The circular cutouts can be made smaller for premature infants. The manufacturer can use their discretion. FIG. 2 is the bassinet foam pad.

Accordingly, the reader will see that the Infant and child back head support pad is versatile and simple to construct for a custom fit at all stages of an infant's head size. The custom fit fabric cover is easily taken off for laundering along with the foam plugs. The pad lies on top of the crib mattress for convenient use.

Other advantages are:

is constructed of a popular foam product that is easy and economical to obtain, but not limited to this;

is able to be manufactured in large numbers with a foam mold injector or with a laser cutter;

is manufactured using few steps;

can easily be altered to a custom cut for premature or disabled infants;

is designed to support the head in a unique way over all other crib mattresses or infant/child bedding;

superior support allows the soft skull to grow in a more natural way by spreading the pressure over the back circumference of the back head instead of a small area in the back of head, or having the head tilt to the extreme right or left head position;

is supportive of the head at several different angles; caregiver can easily readjust the head to a face forward position for supporting the back head curve to allow for longer than usual periods of time with zero pressure on the back head.

Thus the scope of the invention should be determined by the appended claims and their legal equivalents, rather than by the examples given.

What is claimed is:

1. A back head support pad set for supporting the head of an infant or child, comprising:

a. a pad, having a predetermined shape and size to accommodate the head of an infant or child while sleeping, having a plurality of cutouts with an inner ledge disposed within said pad to accommodate the head of the infant or child;

b. said cutouts comprising increasing predetermined diameters to fit and support the growing head as a means of providing support around the outer circumference of the back of the head; whereby the use of said pad by an infant or child would prevent or minimize the condition of plagiocephaly or flat head syndrome.

2. The support pad set forth in claim 1, wherein the said pad has a plurality of plugs in said cutouts as a means for providing a level surface.

3. The support pad set forth in claim 2, wherein said plugs are covered with fabric.

4. The support pad set forth in claim 2, wherein said plugs are made of foam.

5. The support pad set forth in claim 1, wherein said pad is covered with fabric.

6. The support pad set forth in claim 5, wherein fabric cover has a zipper closure and snaps to attach top of the cover to bottom of the cover.

7. The support pad set forth in claim 1, wherein said pad is 1 to 3 inches thick.

8. The support pad set forth in claim 1, wherein said pad is made of foam.

* * * * *